US007540106B2

(12) United States Patent
Weiss

(10) Patent No.: US 7,540,106 B2
(45) Date of Patent: Jun. 2, 2009

(54) CONVERTIBLE CUBE PARTICULARLY USABLE FOR DISPLAY OF PICTURES, OBJECTS, IMAGES, MESSAGES, AND ILLUMINATION PATTERNS

(76) Inventor: George Weiss, 2009 E. 53rd Pl., Brooklyn, NY (US) 11234

( * ) Notice: Subject to any disclaimer, the term of this patent is extended or adjusted under 35 U.S.C. 154(b) by 78 days.

(21) Appl. No.: 11/899,671

(22) Filed: Sep. 8, 2007

(65) Prior Publication Data

US 2008/0172918 A1 Jul. 24, 2008

Related U.S. Application Data

(60) Provisional application No. 60/881,541, filed on Jan. 22, 2007.

(51) Int. Cl.
*G09F 11/18* (2006.01)

(52) U.S. Cl. ..... 40/720; 40/539; 40/610

(58) Field of Classification Search ..... 40/720, 40/124, 622, 539, 610
See application file for complete search history.

(56) References Cited

U.S. PATENT DOCUMENTS 4,854,060 A 8/1989 Corbo et al.
5,613,314 A * 3/1997 Leverenz et al. ..... 40/610
6,497,601 B1 12/2002 Ward

* cited by examiner

*Primary Examiner*—Gary C Hoge
(74) *Attorney, Agent, or Firm*—Aleksandr Smushkovich

(57) ABSTRACT

An article is proposed for display of pictures, images, messages, illumination patterns, etc. placed on outer and inner surfaces of a cube-shaped structure comprising six sides, the adjacent sides are hingedly joined providing for conversion of the structure from a folded cubical state into an unfolded flat state, forming a flat cross-shaped figure, and vice-versa, first fasteners engaging the sides in the folded state and disengaging in the unfolded state, a brace providing a desirable position for the cross-shaped figure, second fasteners engaging and disengaging the cross-shaped figure with the brace, wherein only the outer surfaces are displayed in the folded state, and at least the inner surfaces are displayed in the unfolded state. Embodiments include different types of illumination, means for placement of the pictures on the surfaces, designs of the brace and fasteners. Some embodiments are usable as a Christmas tree cube and as a crucifixion after Christmas.

7 Claims, 3 Drawing Sheets

CONVERTIBLE CUBE PARTICULARLY USABLE FOR DISPLAY OF PICTURES, OBJECTS, IMAGES, MESSAGES, AND ILLUMINATION PATTERNS

CROSS REFERENCE TO RELATED APPLICATIONS

The present patent application partially claims the benefit of a U.S. provisional patent application Ser. No. 60/881,541 filed on Jan. 22, 2007, the disclosure of which is incorporated herein in its entirety by reference. The present patent application also contains new parts not disclosed in the above-indicated provisional application.

FIELD OF THE INVENTION

The invention relates to displayable articles, particularly to those having a convertible cubical shape, whose surfaces are usable for display of pictures, images, messages, three-dimensional objects, illumination patterns, etc.

BACKGROUND OF THE INVENTION

In the prior art, in particular, U.S. Pat. No. 4,854,060 teaches "A collapsible, self-erecting photo display stand is disclosed which can be easily collapsed into a folded configuration and shipped in a flat envelope but will spring into an erected box-like configuration upon removal from the envelope. The device is fabricated by die-cutting and scoring of a sheet of material from a single side into a number of panels and margins which are glued into a novel arrangement. L-shaped margins provide the interconnection between adjacent panels which encourages self-erection to stiffen the finished display."

U.S. Pat. No. 6,497,601 discloses "a collapsible three-dimensional construction in the form of a cube", and mentions a number of similar earlier patented constructions. It may be noticed that such inventions are intended to create "self-erecting" cube-shaped structures from a pre-shaped (mostly pre-cut) two-dimensional blanks, and the outer sides of the cube-shaped structures are utilized in the "erected" state for display purposes, such as, for instance, advertising.

BRIEF DESCRIPTION OF THE INVENTION

It is a primary aim of the present invention to provide creative ways to display pictures, images, messages (including advertisements), three-dimensional objects, illumination patterns, etc., using an easy-convertible cube, without the necessity of complicated instructions. Other aims of the invention might become apparent to those skilled in the art from a consideration of the drawings, ensuing description, and claims as hereinafter related.

The present invention provides the following useful and novel features: using a cube-shaped structure, having outer and inner surfaces, in a folded (cubical) state for display of pictures, images, messages, illumination patterns, etc. on the outer surfaces of substantially planar squared sides of the cube-shaped structure, wherein the adjacent sides are pivotally joined to each other; converting, when necessary, the cube-shaped structure into an unfolded state, forming a substantially flat cross-shaped figure (i.e. a two-dimensional evolvement blank essentially comprising the six sides); fixing the cross-shaped figure in a desirable position; and using at least the inner surfaces of the cube's sides for display of pictures, images, messages, illumination patterns, and three-dimensional objects including pop-up objects, etc. in the unfolded state.

In a preferred embodiment, the inventive article includes a convertible cube structure comprising six squared sides, wherein the adjacent sides so hingedly joined that capable of forming a flat cross-shaped figure in the unfolded state. The cross-shaped figure thusly has a central square, four adjoining squares adjacent to the central square, one peripheral square adjacent to one of the four adjoining squares, four hinges connecting the central square to the four adjoining squares and one hinge connecting the one of the four adjoining squares to the peripheral square adjacent thereto. On the outer surface, the four edges of each side are made beveled allowing the unfolding, i.e. the conversion into the flat unfolded state. The hinges are made of a suitable configuration that enables the cube to convert from the folded into the unfolded state, and vice-versa.

In some embodiments, suitable incisions can be made, rather than hinges, which incisions permit the cube to be pivotally opened and closed. The cube's sides can be made of wood, plastic, non-transparent plexiglas, colored glass, metal, cardboard, composite materials, or any other materials that don't change their look, function, ease of use, or another necessary property in common conditions.

The cube structure comprises first fastening means for releasably fixing the structure in the folded state. In some embodiments, the first fastening means can be represented by elongated male-female projections-slots respectively mounted in suitable regions on the inner surfaces of the sides. In other embodiments suitably located pins (or prongs) and orifices (or sockets) can form a tightly fitting fastener pair. Optionally, adhesive attachments, Velcro™ strips or pieces, magnetic members, a hook and loop type of fastener, zippers, snaps, suitable latches or locks, or the like may be used to provide the functionality of the first fastening means.

The outer surfaces of the sides can be individually decorated, e.g. with printed pictures illustrating Christmas topics, so that, while being in the folded state, the cube may hang on a Christmas tree, or alternatively be attached to a tree's branch with a springed peg or the like.

In some embodiments, the outer surfaces of the sides can be covered with clear pockets, so that the pictures can be inserted into and removed therefrom. Other embodiments may include a set of squared or otherwise shaped plates with images or messages that can be removably attached to the outer surfaces of the sides by means of different fasteners, for instance, of the above mentioned, or other known types.

Yet, other embodiments may have illumination means arranged on the sides (on the inner and/or outer surfaces) with a power source hidden, for example, inside the cube, or in another suitable place. Such illumination means may include fluorescent coatings, LEDs of different colors (in some cases, the power source can be represented by capacitor circuitry capable to keep charge long enough, and chargeable from electromagnetic circuitry inducing electric current during occasional movements of the cube), traditional incandescent lamps, etc.

Mirrored, semi-mirrored, frosted glass, and other materials can be utilized to cover the outer surfaces. The illumination may be accompanied with sounds, vibrations, and other known effects.

The inventive article comprises a solid brace means for supporting the cross-shaped figure in an upright position in the unfolded state, or generally for providing a desirable position for the cross-shaped figure. Optionally, the brace means may be made of transparent material, so that both the outer and the inner surfaces of the cube's sides can be displayed in the unfolded state.

In alternative embodiments, a plurality of rigid members (clamps, staples, pieces of wire, etc.) can be arranged to provide the functionality of the solid brace. The rigid members (not illustrated herein) would need to connect adjacent sides over the hinge in the unfolded state. In order to convert back to the folded state, the rigid members would have to be removed or otherwise disconnected.

The rigid members can be substituted by a solid frame (not shown) having corresponding slots to accommodate the edges of the flat cross-shaped figure. Optionally, the frame can be made of two half-frames suitably joinable (not shown). Yet, other embodiments may utilize inflatable brace members (not shown).

The inventive article comprises second fastening means for fixing the cross-shaped figure to the brace means in the unfolded state.

The brace means can be removably mounted upon a footing base, e.g. made in the form of a cube, cylinder, etc. to hold the brace means, for example, in the upright position, while the base stands on a surface (of a wall unit, shelf, table, desk, etc.) In optional embodiments, the brace may have a hanging means in the form of a hanging hole (not shown) or a loop (not shown), and thus can be hung on the wall, on a piece of furniture, or in a car.

If needed, some embodiments might provide for one brace to simultaneously support two cross-shaped figures (converted from two such cubes), attached to the brace from its two flat sides (not shown), so that only two of the four (two inner and two outer) surfaces of the two cubes would be displayed. In such a case, fastening means similar to the above described could be used, but suitably allocated on the brace.

The inner surfaces of the cube's sides, according to the invention, may also be utilized for display of pictures, images, messages, illumination patterns, etc. in the unfolded state. In particular, it is convenient to use the inner surface of the cross-shaped figure for display of crucifixion, having a similar cross shape.

Other images can be attached to the inner surface in alternative embodiments. Similarly to the outer surfaces, the inner surfaces of the cube's sides may be covered by attachable plates with images, or pictures insertable into clear pockets arranged thereon, or by illumination patterns, or by other aforementioned means.

The utility of opening and closing the cube in order to see its inner (initially hidden) sides, or read messages placed thereon, should be very appealing. When displayed as a cube, people will be curious to see its hidden inner parts. It therefore may be used as a novel kind of greeting article or a gift for Christmas or other occasions. The owners of the Christmas embodiment may have it in the cube form on Christmas, and in the crucifix form after it, until the next Christmas.

In a commercial embodiment, the inventive product is called "AMAZIN' CUBE-R-AMA"™. A preferable packaging design has two aforementioned cubes with different artwork (e.g. two crucifixes of different colors, or otherwise distinguished) with two support braces and two footing bases, placed into an attractive transparent cover-box.

The cube can also represent a puzzle message placed on its outer surfaces, whereas the answer or solution is hidden inside by placing it on the inner surface. In particular, a game can be arranged: one gives out a plurality of cubes with different puzzles, for example, to children asking to guess the puzzles. Those who got the right answers or solutions would be awarded.

In special embodiments, a plurality of cubes can be sold (or given out) as a lottery game, for instance during a party. Only one (or may be more) cube contains the winning message inside on its inner surfaces.

The cube may be accomplished as a piece of jewelry, for instance having the outer surfaces made of gold with impressed images thereon, while the inner surfaces are performed with a gemstone in the center of each squared side, or having a crucifixion, or otherwise ornamented. In such embodiments, the outer and/or inner surfaces can be made of or covered by at least one of the following materials: gold, silver, platinum, gemstones, diamonds, and artificial gemstones or diamonds.

In preferred embodiments, the inventive article does not have any moving, detachable, or removable parts (except the brace) that makes it safe even when handled by children or persons with disabilities.

BRIEF DESCRIPTION OF THE DRAWINGS

Identical reference numerals in the drawings generally refer to the same elements in different figures. A first-time introduced numeral in the description is enclosed into parentheses.

DESCRIPTION OF AN EXEMPLARY EMBODIMENT OF THE INVENTION

Figure 1:
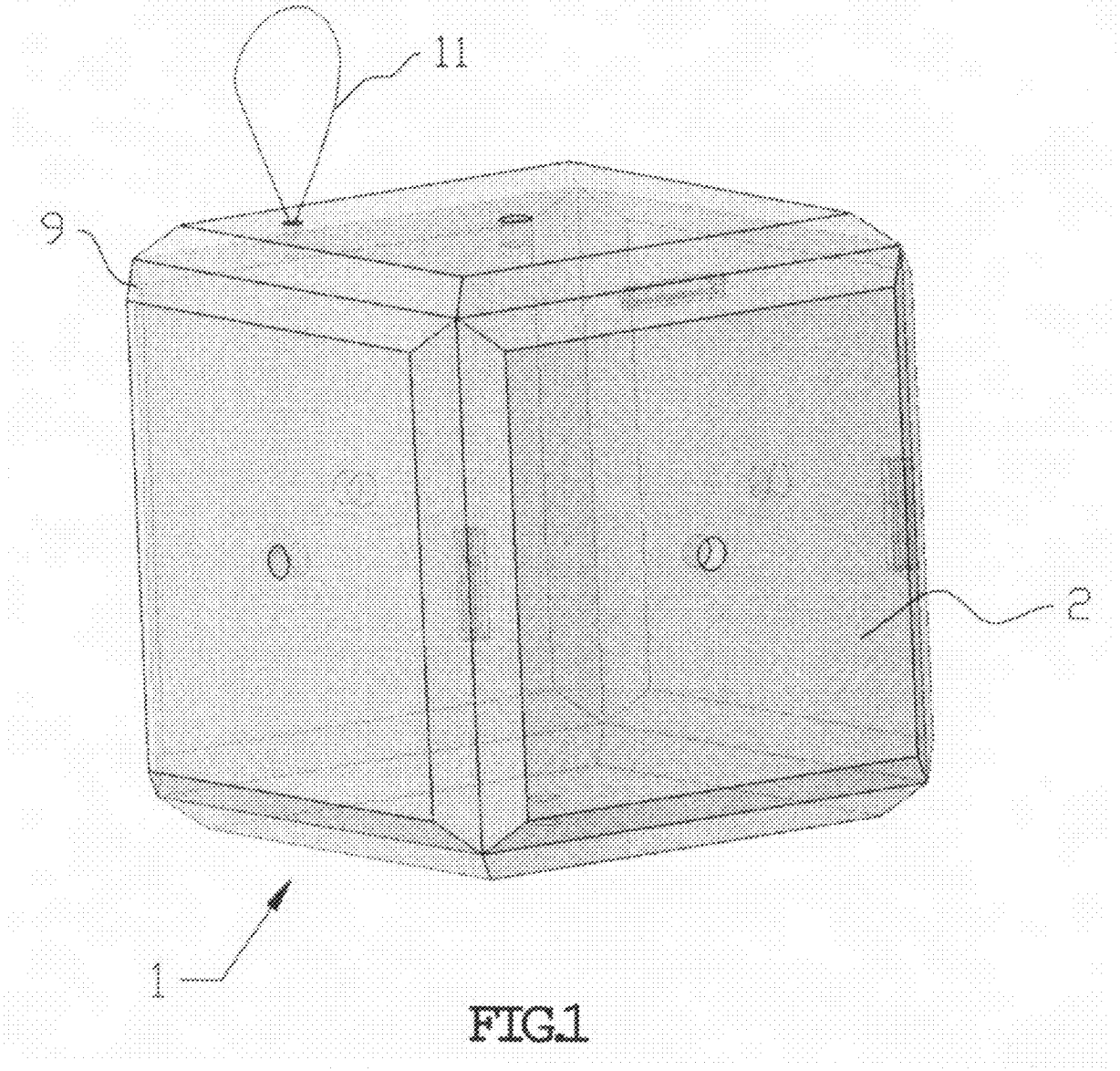
FIG. 1 illustrates a general perspective view of a cube structure in the folded state, according to an exemplary embodiment of the present invention.

While the invention may be susceptible to embodiment in different forms, there is shown in the drawings, and will be described in detail herein, a specific exemplary embodiment of the present invention, with the understanding that the present disclosure is to be considered an exemplification of the principles of the invention, and is not intended to limit the invention to that as illustrated and described herein.

A preferred embodiment of the inventive cube structure (1) is depicted on FIG. 1 in its folded state. The structure 1 comprises six planar sides (2) so hingedly joined that capable of forming a flat cross-shaped figure in the unfolded state, whose outer surfaces are shown on FIG. 2. The hinges (12) and (12') are conditionally illustrated on FIG. 2. On the outer surface, the sides 2 have four edges (9), each of the edges 9 is made beveled allowing the unfolding. Each of the sides 2 has, preferably in its center, an orifice (3) of a predetermined size, as a first counterpart of the second fastening means. A wire (11) is attached to one of the sides (shown on FIG. 1) to hang the cube 1, for example, on a Christmas tree. The wire 11 can also be used as a pull to open the cube for conversion it into the cross-shaped figure.

Figures 2, 3, 3A:
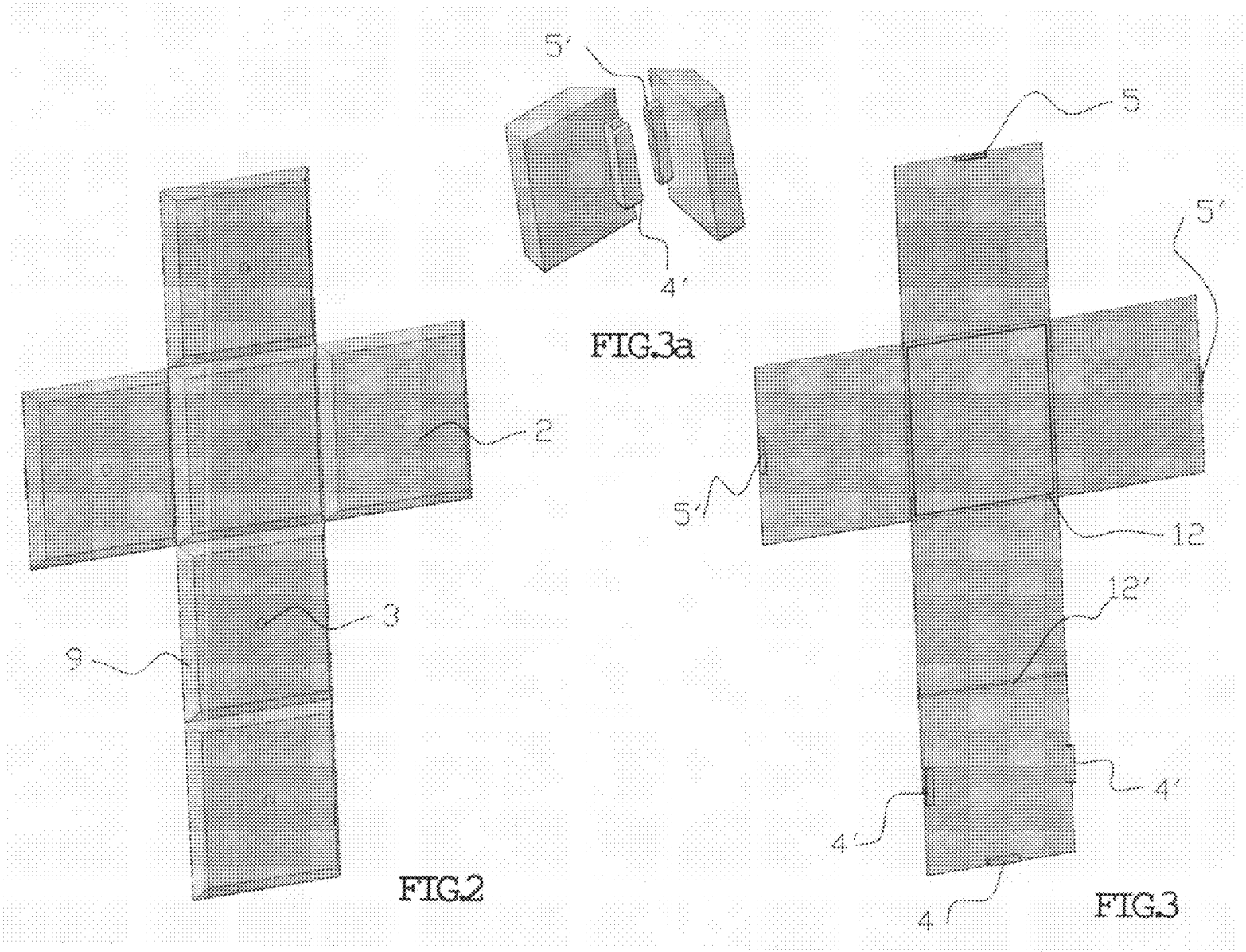
FIG. 2 illustrates a frontal view of the outer surfaces of the cube structure shown on FIG. 1 in the unfolded state.
FIG. 3 illustrates a frontal view of the inner surfaces of the cube structure shown on FIG. 1 in the unfolded state.
FIG. 3*a* illustrates a detail view of the first fastening means in the form of a male projection and female slot.

FIG. 3 shows the inner surfaces of the cube structure 1 in the unfolded state, i.e. the cross-shaped figure. The edges of inner surfaces of the sides 2 are shown plane in this embodiment.

In the preferred embodiment illustrated in the drawings, the first fastening means are chosen in the form of a fastener, composed of essentially rectangular elongated male projections (5) or (5') capable to tightly and removably fit into respective essentially rectangular elongated female slots (4) or (4') having a substantially 'n'-shaped cross-section of a predetermined size, as pictured on FIG. 3. The projection 5' and the slot 4' are separately depicted on FIG. 3*a*. Preferably the 'n'-shape can be made slightly narrower at the bottom and slightly wider at the top. The projections 5 and 5' and slots 4 and 4' are made of suitable material having a predetermined degree of elasticity to provide engagement of the projections and the slots, when one fastens them into the folded state, and easy disengagement when one opens them to unfold the cube structure.

Figure 4:
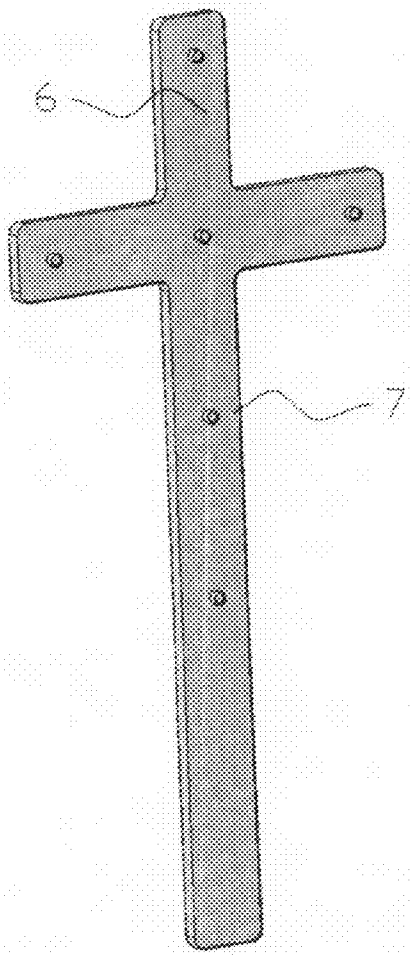
FIG. 4 illustrates a frontal view of a brace, according to the exemplary embodiment of the present invention.

A solid flat cross-shaped brace (6) of this embodiment, made of suitable materials, is shown on FIG. 4. The brace 6 includes pins (7) fixed to its body. The pins 7 represent a second counterparts of the second fastening means, so located that capable to removably fit into the orifices 3 to provide support and the upright position of the cross-shaped figure of the cube's structure in the unfolded state.

Figure 5:
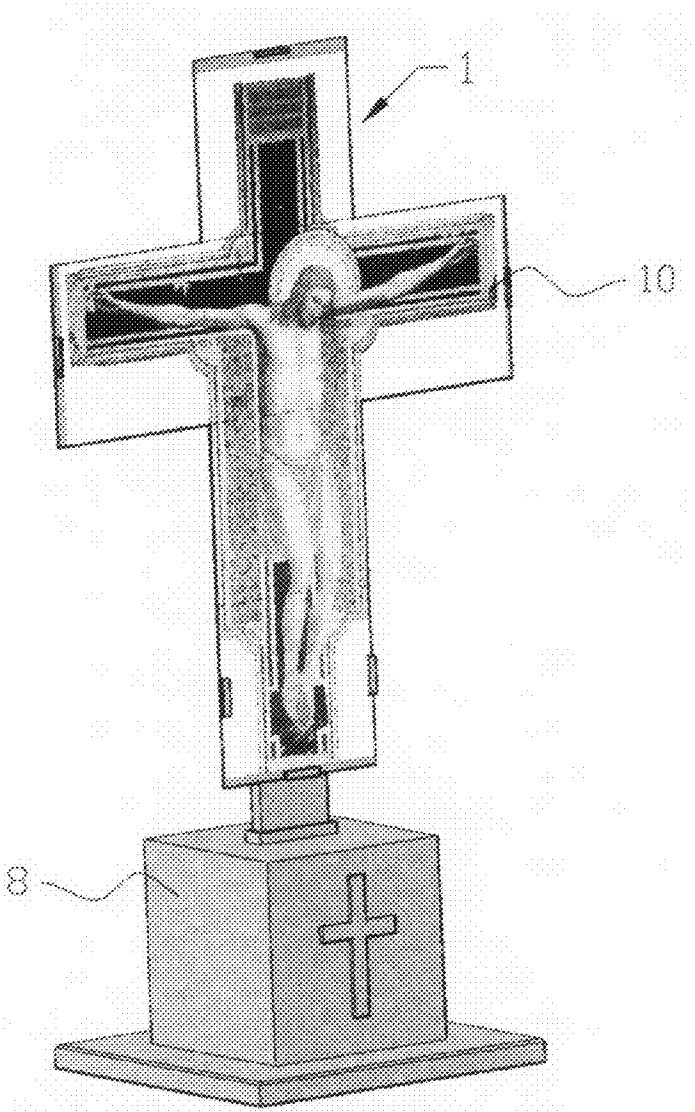
FIG. 5 illustrates a general perspective view of an assembly of the cube structure in the unfolded state with a base footing means, according to the exemplary embodiment of the present invention.

FIG. 5 shows an assembly of a cube-shaped footing base (8) with the cube structure 1 in its unfolded state (i.e. with the cross-shaped figure) supported by the brace 6 (not seen in FIG. 5). In this embodiment the base 8 comprises a slot (not shown) in its upper portion for insertion of the brace 6. The inner surfaces of the cross-shaped figure incorporate a crucifixion image (10) displayed on FIG. 5.

When the cube 1 is unpacked, it's in the folded state, and can be hung on the Christmas tree. After the end of Christmas, one opens the cube by releasing the male projections 5 and 5' from the female slots 4 and 4', thereby converting the cube structure 1 into the unfolded state, i.e. making the flat cross-shaped figure including the orifices 3.

One then couples the pins 7 of the brace 6 with the orifices 3, so that the inner surfaces of sides 2 would be displayed. One inserts the lower portion of the brace 6 into the mentioned slot of the base 8, thereby installing the brace 6 with the cube structure 1 in the form of the cross-shaped figure. The crucifixion image 10 will thus be displayed in the upright position.

I claim:

1. An article for display of indicia, comprising:

a structure including six planar sides having outer and inner surfaces, said indicia placed on at least said inner surfaces, selected adjacent sides of said six planar sides pivotally joined to each other providing for conversion of the structure from a folded cubical state into a substantially flat, cross-shaped unfolded state;

first fastening means for engaging selected sides in the folded state, and for disengaging the sides to convert the structure from said folded cubical state into said cross-shaped unfolded state;

a retaining means for retaining said structure in said cross-shaped unfolded state; second fastening means for engaging and disengaging said structure with said retaining means, the second fastening means including first counterpart portions coupled to said structure, and second counterpart portions coupled to said retaining means;

wherein only said outer surfaces are displayed in the folded state, and at least said inner surfaces are capable of being displayed in the unfolded state.

2. The article according to claim 1, wherein the outer and/or inner surfaces are covered by at least one of the following materials: mirrored, semi-mirrored, and frosted glass.

3. The article according to claim 1, wherein the outer and/or inner surfaces made of or covered by at least one of the following materials: gold, silver, and platinum.

4. An article for display of indicia, comprising:

a structure including six planar sides having outer and inner surfaces, said indicia placed on at least said inner surfaces, selected adjacent sides of said six planar sides hingedly joined to each other providing for conversion of the structure from a folded cubical state into a substantially flat, cross-shaped unfolded state;

a plurality of first fasteners for engaging selected sides in the folded state, and for disengaging the sides to convert the structure from said folded cubical state into said cross-shaped unfolded state, said first fasteners comprising essentially rectangular elongated male projections capable of being tightly and removably fit into respective essentially rectangular elongated female slots having a substantially 'n'-shaped cross-section of a predetermined size;

a solid brace for retaining said structure in said cross-shaped unfolded state; and a plurality of second fasteners for engaging and disengaging said structure with said brace, the second fasteners including orifices of a predetermined size made in said structure, and pins coupled to said brace so located as to removably fit into the orifices;

wherein only said outer surfaces are displayed in the folded state, and at least said inner surfaces are capable of being displayed in the unfolded state.

5. The article according to claim 4, wherein said solid brace is made of transparent material.

6. The article according to claim 4, further comprising a footing base, and said solid brace made mountable upon the footing base.

7. The article according to claim 4, wherein said 'n'-shape made predeterminedly narrower at the bottom and predeterminedly wider at the top.

* * * * *